US007617790B2

(12) United States Patent
Michel et al.

(10) Patent No.: US 7,617,790 B2
(45) Date of Patent: Nov. 17, 2009

(54) SYSTEM AND METHOD FOR PROVIDING IMPROVED PASSENGER AMENITIES ON A CRUISE SHIP

(75) Inventors: Gregory Michel, Los Angeles, CA (US); Thomas Mazloum, Redondo Beach, CA (US); Alexandra Don, Marina del Rey, CA (US)

(73) Assignee: Crystal Cruises, Inc., Los Angeles, CA (US)

( * ) Notice: Subject to any disclaimer, the term of this patent is extended or adjusted under 35 U.S.C. 154(b) by 142 days.

(21) Appl. No.: 11/874,114

(22) Filed: Oct. 17, 2007

(65) Prior Publication Data

US 2009/0101055 A1 Apr. 23, 2009

(51) Int. Cl.
*B63B 3/00* (2006.01)

(52) U.S. Cl. ..... 114/65 R; 114/71

(58) Field of Classification Search ..... 114/65 R, 114/71

See application file for complete search history.

(56) References Cited

U.S. PATENT DOCUMENTS 4,779,552 A * 10/1988 Harsia et al. ..... 114/65 R
6,457,431 B1 10/2002 Niskanen et al.
6,755,143 B2 6/2004 Mermier et al.
7,156,031 B2 1/2007 Mermier et al.

FOREIGN PATENT DOCUMENTS

EP 1 454 824 A2 9/2004
EP 1 816 067 A2 8/2007

OTHER PUBLICATIONS

Royal Caribbean Freedom Class Virtual Tour ship built Jun. 4, 2006.*
RCL Freedom of the Seas.*
Freedom the the Seas glass window.*
Freedom of the Seas promenade.*
International Search Report, dated Feb. 6, 2009, from PCT/US2008/069101.

* cited by examiner

*Primary Examiner*—Stephen Avila
(74) *Attorney, Agent, or Firm*—Greenberg Traurig LLP

(57) ABSTRACT

A cruise chip having a plurality of decks, certain of the decks having a plurality of staterooms therealong, the plurality of spaced staterooms extending along one of the decks and a second plurality of spaced staterooms extending along another of the decks directly above the other of said decks, and a single central double height corridor extending inboard of the ship, each of the plurality of spaced staterooms and shared entryways coming from the single central corridor and leading into a pair of side by side staterooms, the corridor terminating in a transparent glass window spanning one the decks to the other of decks.

23 Claims, 14 Drawing Sheets

SYSTEM AND METHOD FOR PROVIDING IMPROVED PASSENGER AMENITIES ON A CRUISE SHIP

BACKGROUND

General Background

This disclosure relates to cruise ships; and, more particularly, to a system and method for providing improved passenger amenities and desirable locations on a cruise ship.

SUMMARY

Related Art

Many changes have taken place in the cruise ship industry in recent years. A new type of cruise ship passenger, the baby boomer, has come along. This new generation passenger is interested in the ultimate luxury that a cruise ship has to offer.

There is a need for a cruise ship wherein light penetrates into various areas of the ship. Such improved amenities should include staterooms giving one a feeling of open areas, light and unrestricted views. A sense of the outside light surrounding the cruise ship is brought into the interior of the cruise ship.

These and other objects are preferably accomplished by providing a cruise ship having a plurality of decks, certain of the decks having a plurality of staterooms therealong. There are a plurality of spaced staterooms extending along one of the decks, and a second plurality of spaced staterooms extending along another of the decks directly above one of the decks.

A single central corridor is inboard the plurality of spaced staterooms, and the single central corridor terminates in a transparent glass window extending from one of the decks to the other forming a double height corridor.

Other important features are shared entryways coming from the single central double height corridor and leading into a pair of side by side staterooms, a main dining area having an upper mezzanine with a floor to ceiling glass window, a lockable area functioning as walk-in safe or closet in the staterooms, a high ceiling area in the staterooms providing a loft effect and a crystal-like effect on the outside of the cruise ship. Another feature is a grand atrium light shaft extending from a lower deck to the upper deck terminating in a skylight having a window garden area. A vertical promenade may be provided midship eliminating the need for fore and aft stairwells flowing downwardly from the upper deck The above-mentioned features and objects of the present disclosure will become more apparent with reference to the following description taken in conjunction with the accompanying drawings wherein like reference numerals denote like elements and in which:

DRAWINGS

DETAILED DESCRIPTION

Figure 1:
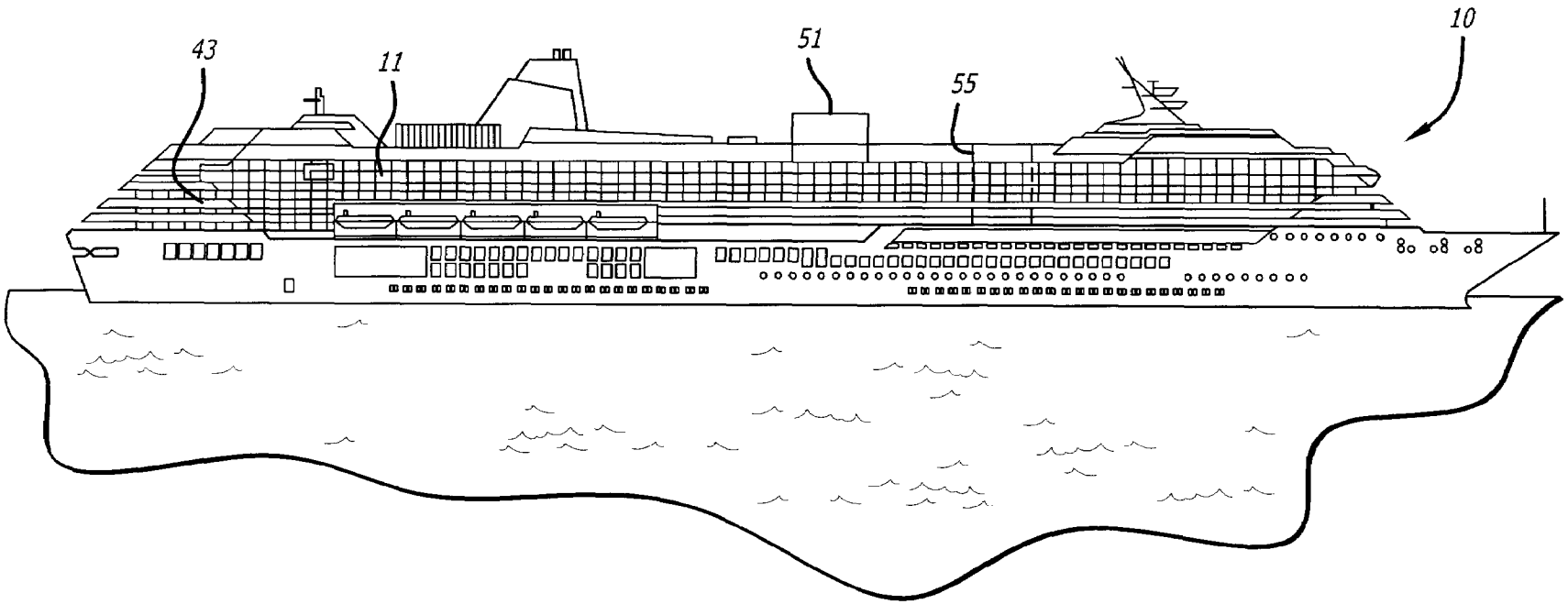
FIG. 1 is an elevational view of a cruise ship in accordance with the disclosure, parts broken away for convenience of illustration.

Referring to FIG. 1 of the drawings, a cruise ship 10 in accordance with the disclosure is shown, broken away to show a plurality of decks 11 as is well known in the art.

Figure 2:
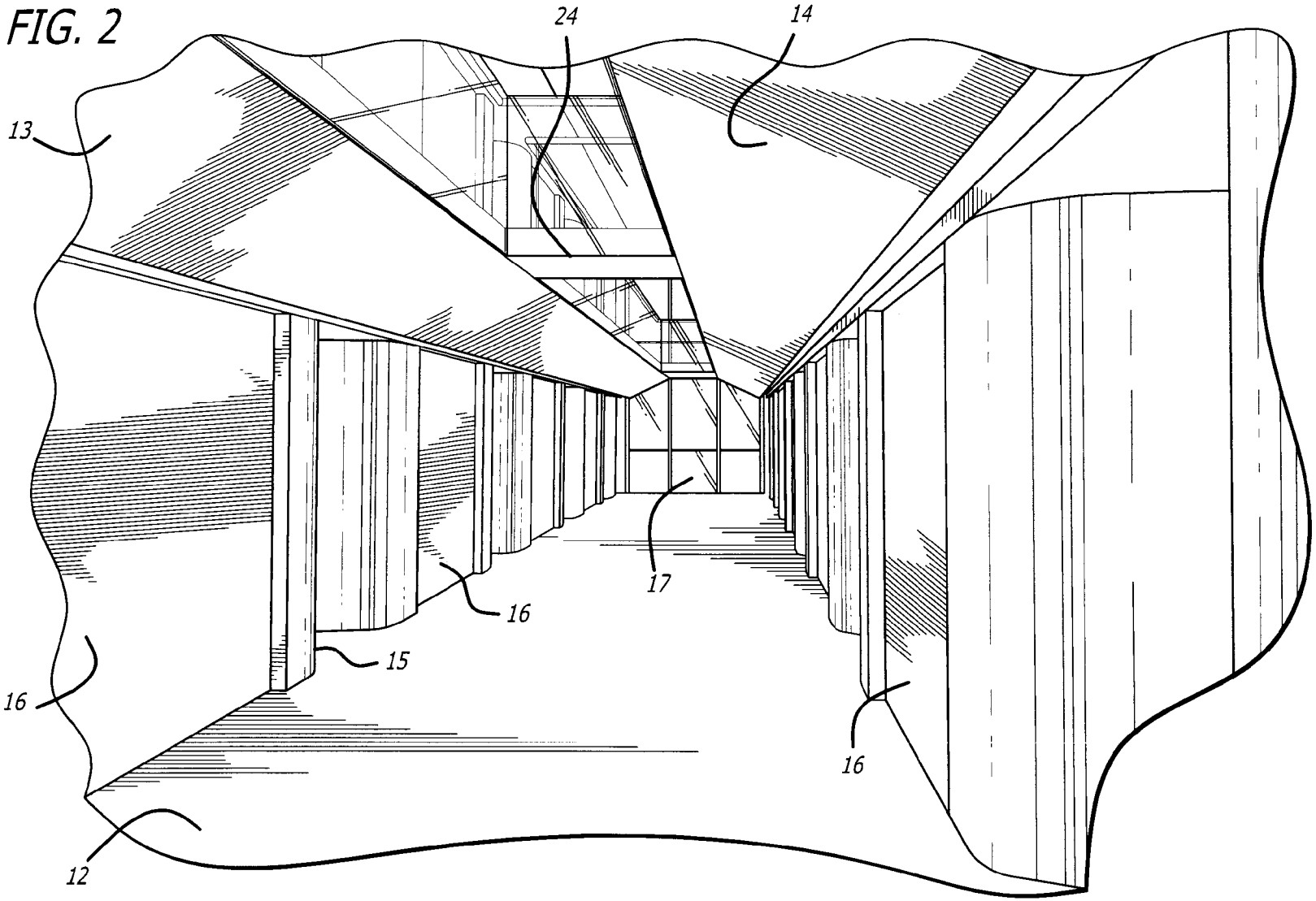
FIG. 2 is a perspective view of side by side staterooms on two decks coming into a single double height central corridor in accordance with the teachings of the disclosure.
Figure 3:
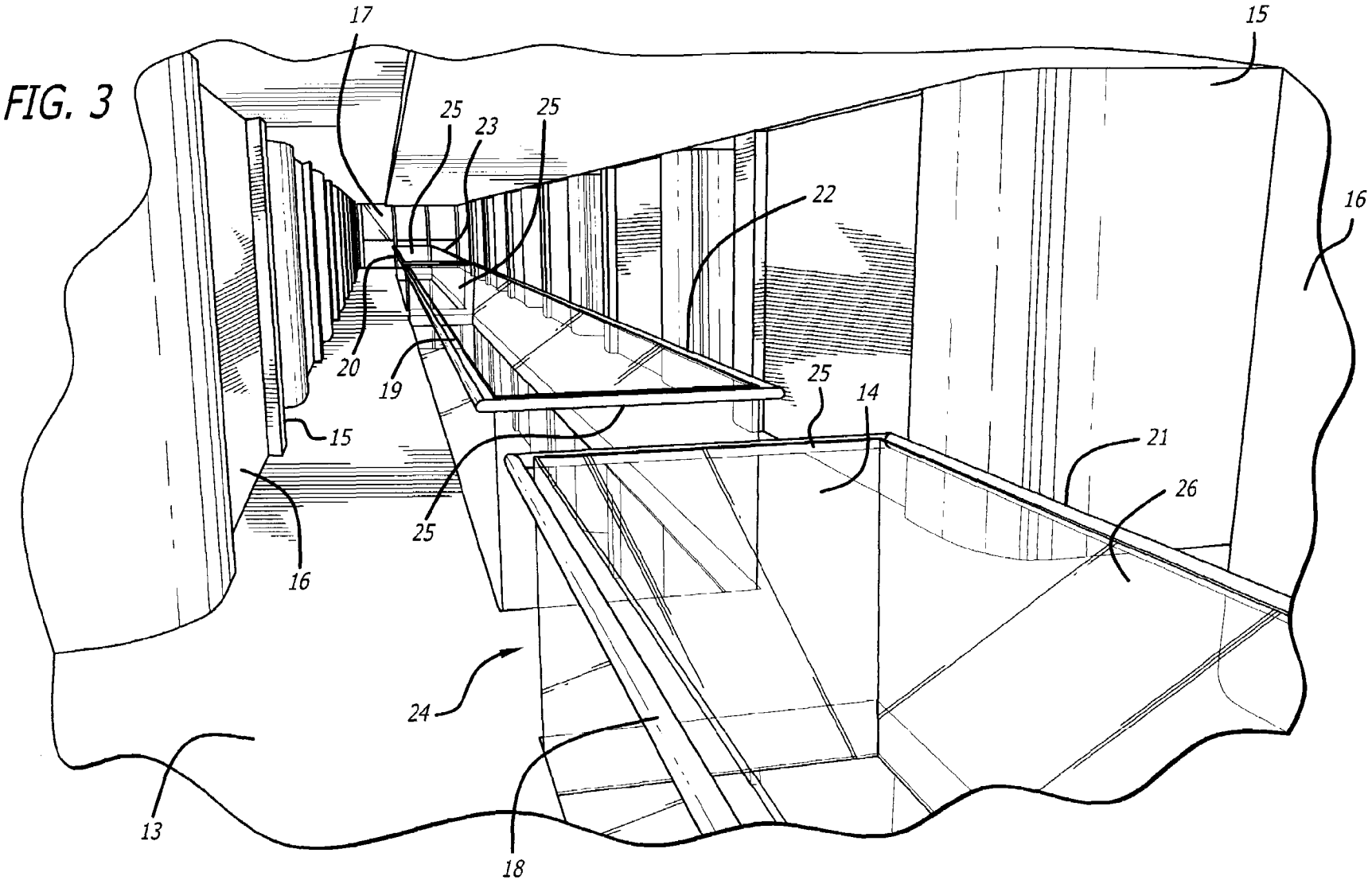
FIG. 3 is a perspective view of the upper level of the single central double height corridor of FIG. 2.

As particularly contemplated in the present disclosure, a number of innovative features are present in cruise ship 10. Thus, as shown in FIGS. 2 and 3, one or more decks 11 (FIG. 1) of ship 10 may have a bottom floor 12 on one deck and upper spaced floor sections 13, 14 (see also FIG. 3) on an upper deck. As particularly seen in FIG. 2, entryways 15 separate cabins 16 from each other as will be discussed. A window 17 extends from floor 12 up past floor sections 13, 14 as seen by comparing FIGS. 2 and 3. On the deck above floor 12, FIG. 3, floor sections 13, 14, along with floor 12, form a single central double height corridor with railings 18-20 extending along and above floor section 13 with like railings 21 to 23 extending along and above floor section 14. Passageways 24 are provided between floor sections 13, 14 with rail portions 25 connecting railings 18, 21; 19, 22; and 20, 23, as shown.

Of course, any suitable number of railings and passageways may be provided. However, glass paneling or partitions 26 are used throughout between the railings, rails and floor sections 13, 14. This gives an open appearance formed by the floor sections and railings, particularly in conjunction with window 17 which extends from the lower deck to the upper deck such that the environs are "brought into" the single central double height corridor.

Figure 4:
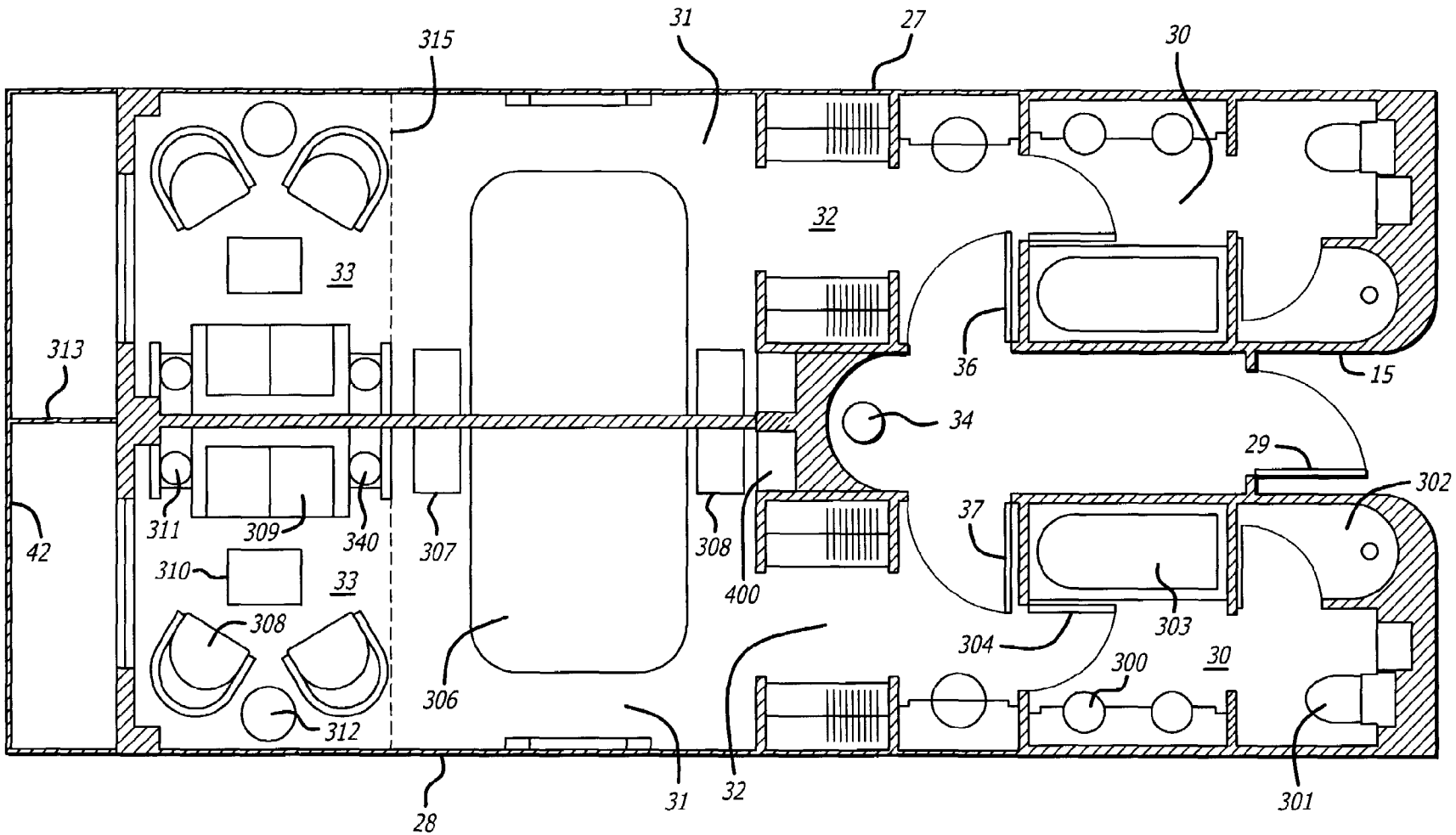
FIG. 4 is a plan view of the layout of a pair of staterooms.

Referring now to FIG. 4, the shared entryways 15 lead into the staterooms coming off the single central double height corridor, such as side by side staterooms 27, 28. These staterooms are essentially identical and may be occupied by one client in each stateroom, or combined so that, for example, part of one family may be lodged in stateroom 27 and another part of the same family lodged in stateroom 28 for privacy. Thus, each stateroom 27, 28 has a door 36, 37 opening into each of the 2 suites. Each suite has a bathroom 30, which may have side by side sinks 300, toilet 301, shower 302 and tub 303. A door 304 closes off bathroom 30 and a vanity 305 is provided between bathroom 30 and closets 32 which closets 32 lead into bedroom 31 having one or more beds 306 and suitable nightstands 307, 308. A living room 33 is next to bedroom 31 having suitable chairs 308, couch 309, tables 310, 340, 312, hanging lamps 311, etc.

A verandah 42 extends outboard of each living room 33 in each suite and may be separated by a wall 313. Dotted line 315 indicates where the loft area of living room 33 begins, as will be discussed.

Figure 5:
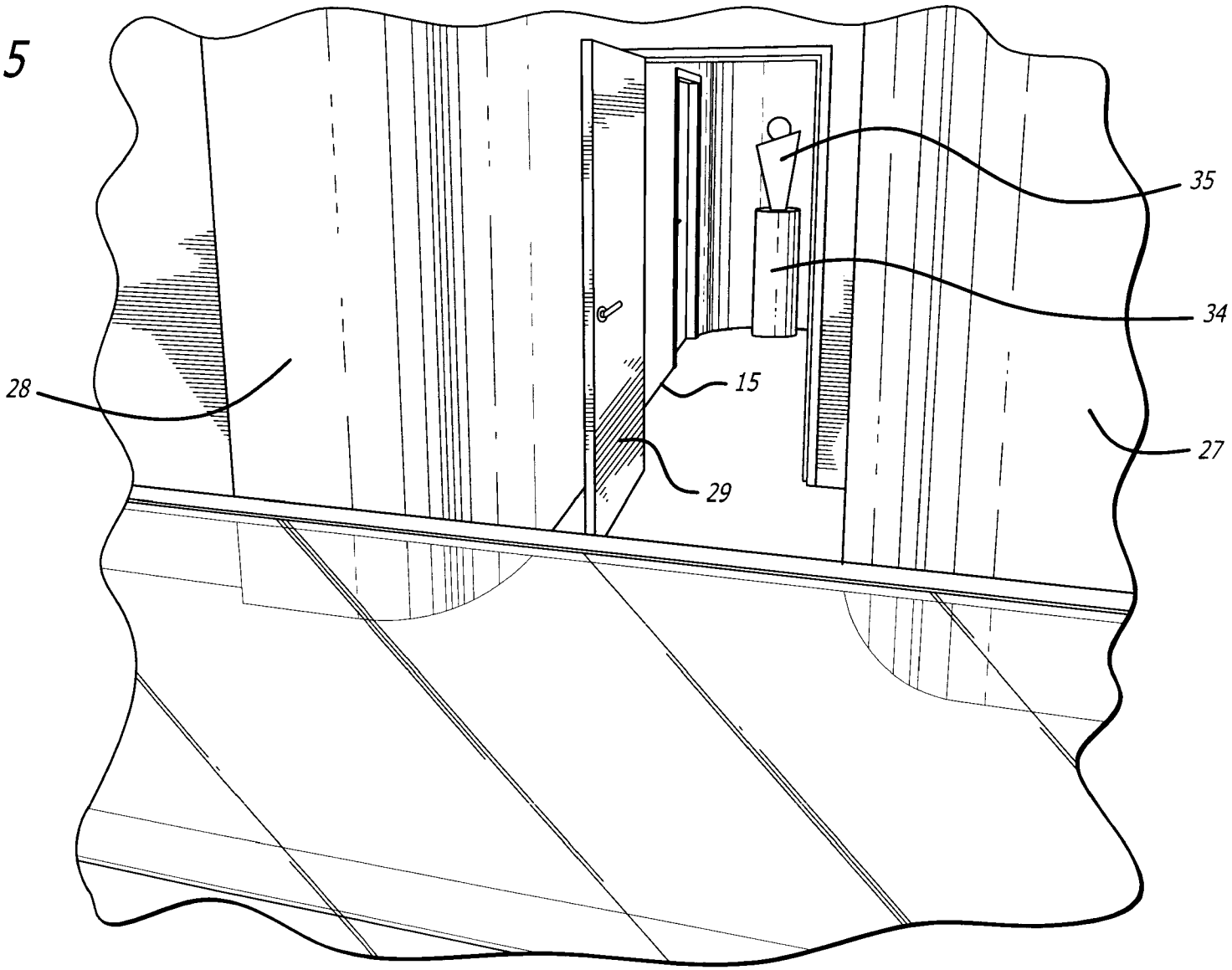
FIG. 5 is a perspective view of a shared entryway coming from the single central corridor and leading into a pair of side by side staterooms in accordance with the teachings of the invention.
Figure 6:
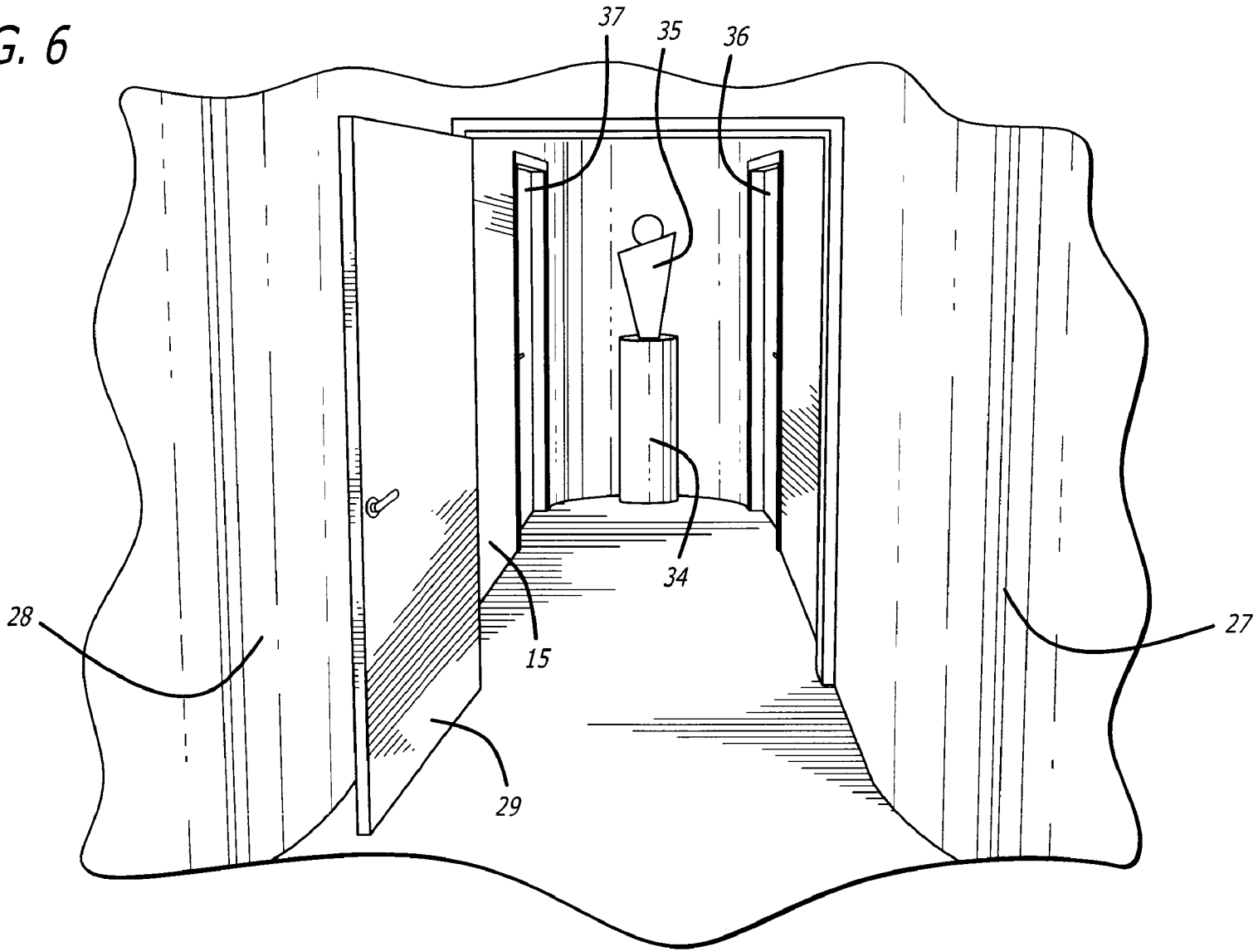
FIG. 6 is a view similar to FIG. 5 illustrating the placement of doors leading into each side by side stateroom.

As seen in FIG. 5, door 29 opens into the interior of shared entryway 15, which may be tastefully decorated, as with a pedestal 34 and sculpture 35. FIG. 6 show entry doors 36, 37 closing off staterooms 27, 28, respectively.

Figure 9:
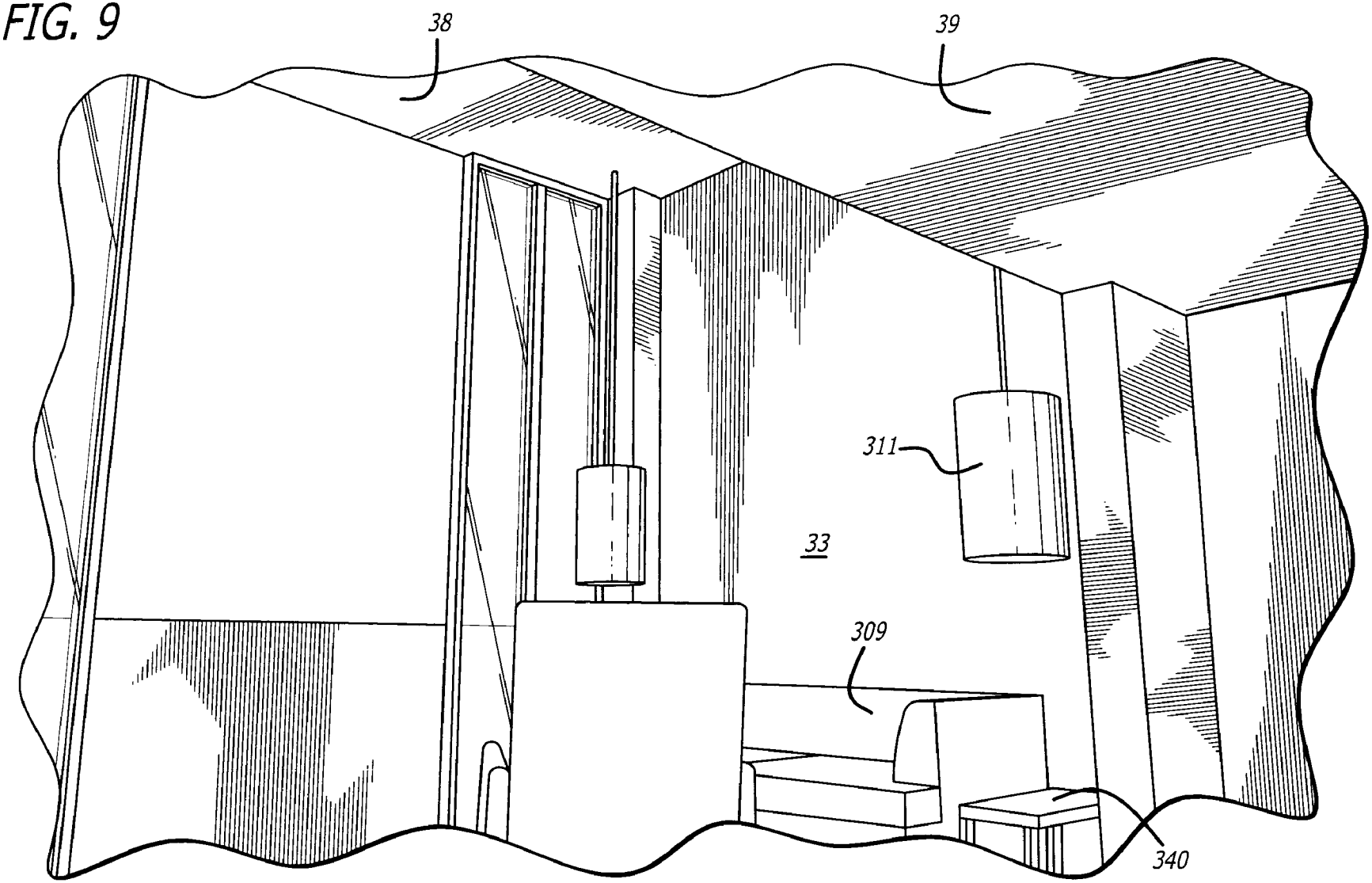
FIG. 9 is a perspective view of the living room of one of the staterooms.
Figure 10:
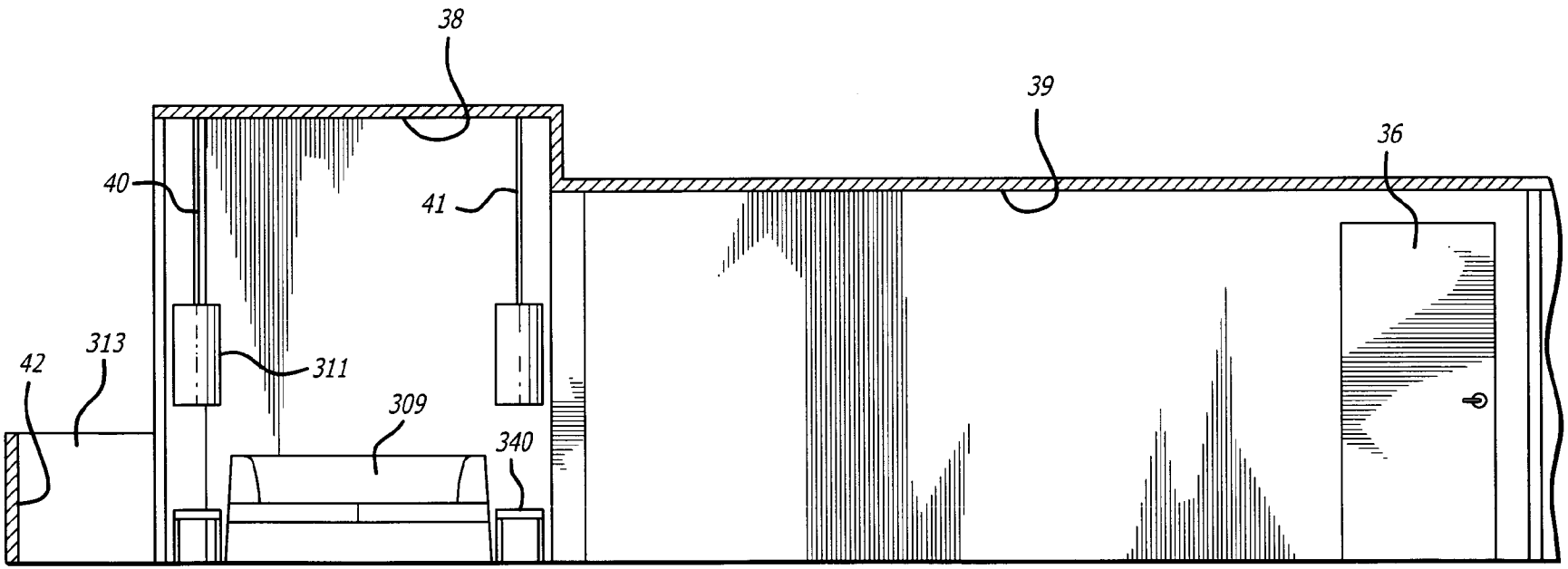
FIG. 10 is an elevational view of the living room and another area of the stateroom of FIG. 9.

Living room area 33 is shown again in FIG. 9 and may have a ceiling 38 higher than the ceiling 39 in the remainder of the staterooms (see also FIG. 10). The hanging lamps 311 extending down from ceiling 38 give a sense of height and openness on the outboard side of the stateroom leading to verandah 42.

Referring again to FIG. 1, the cruise ship 10 may have, on the outside thereof, a portion thereof indicated at 43, which is normally closed off from the interior by clear glass, covered with glass panels 44 (FIG. 11) giving a "crystal" effect. This effect may be carried throughout the entire ship 10.

Figure 12:
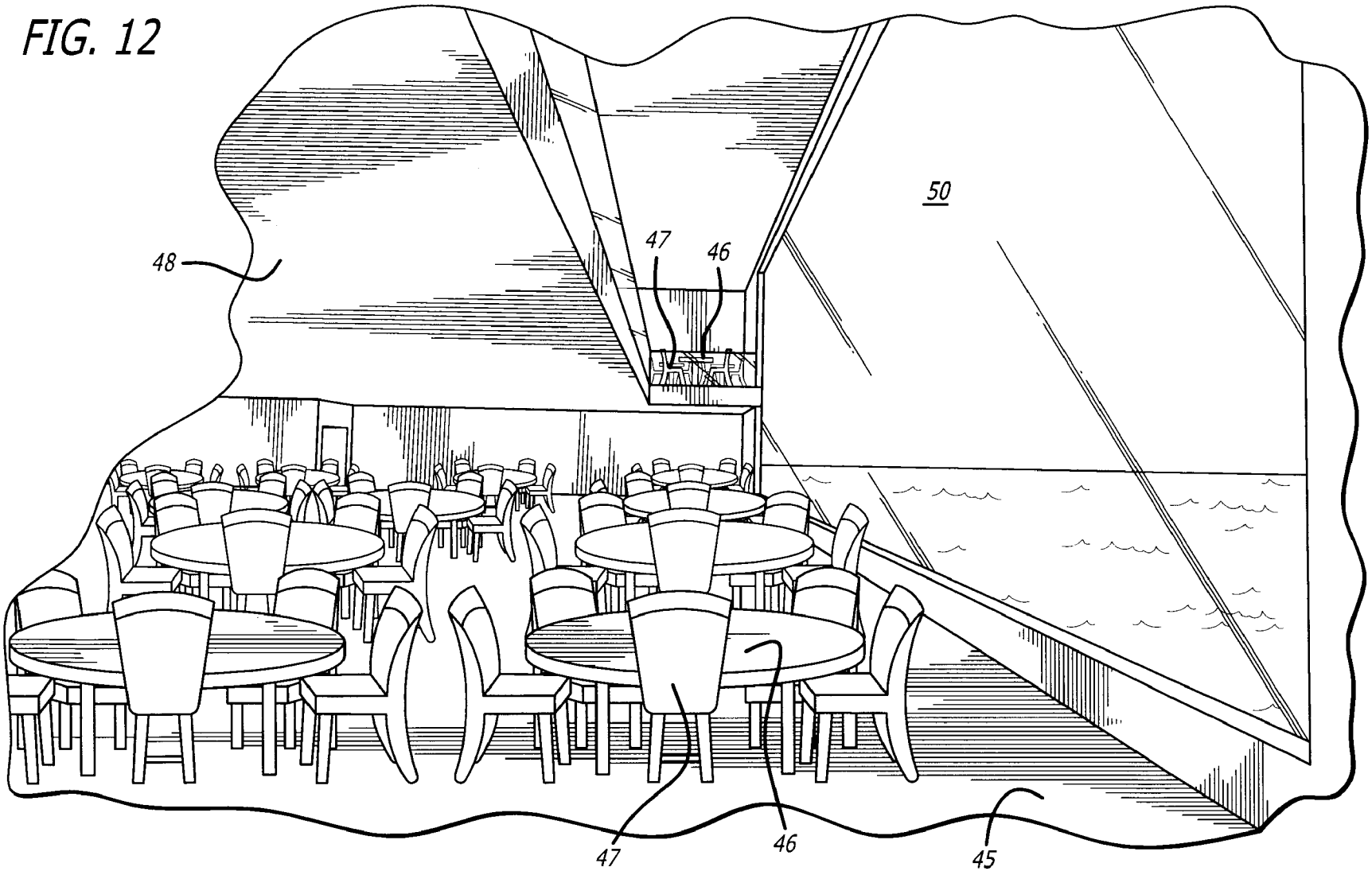
FIG. 12 is a perspective view of the main dining room of the cruise ship of FIG. 1.
Figure 13:
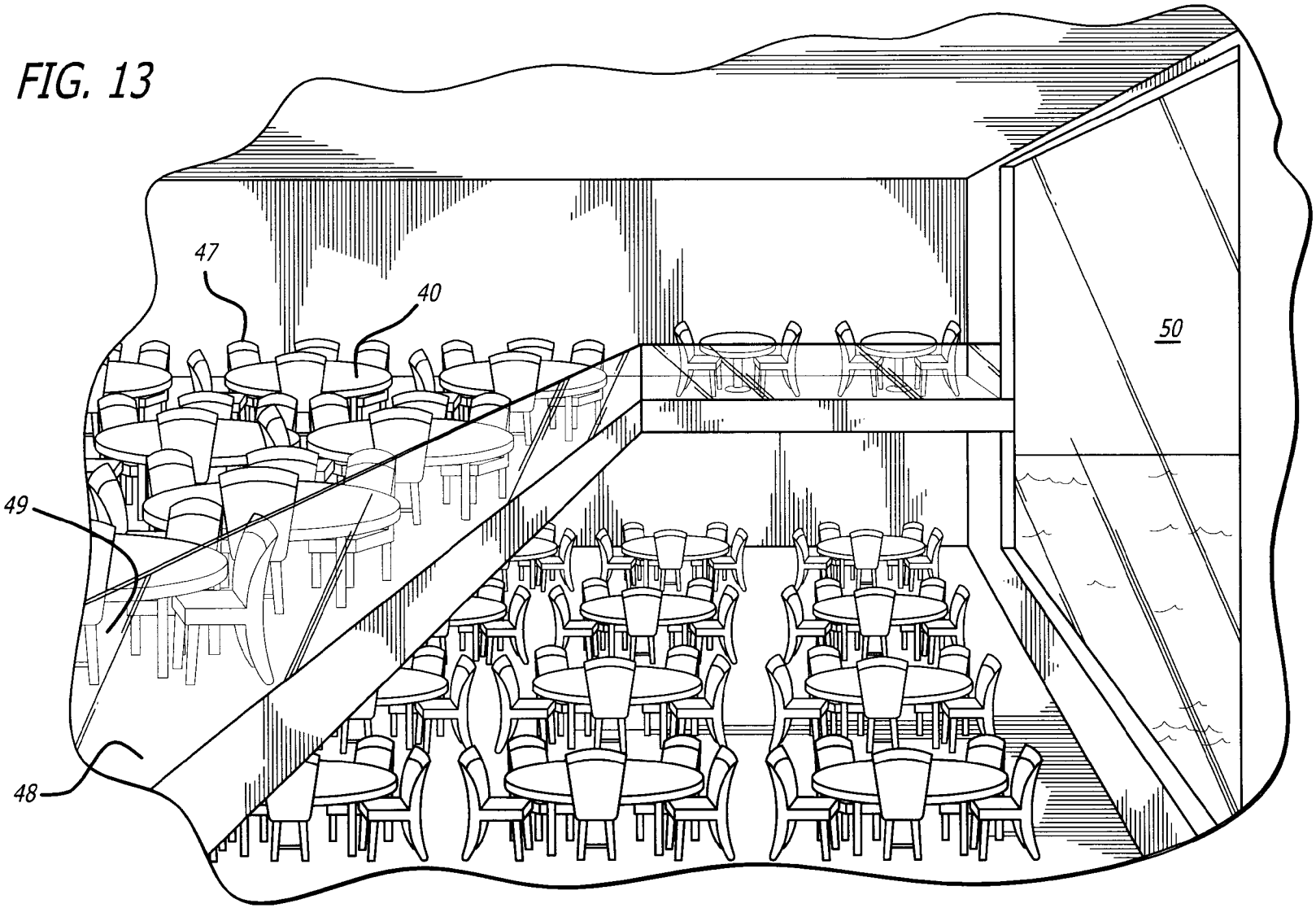
FIG. 13 is a perspective view of the dining room of FIG. 12 illustrating the upper mezzanine area.

As seen in FIG. 12, the cruise ship 10 has a main dining room 45 with a plurality of spaced tables 46 and chairs 47. An upper mezzanine level 48 is provided also having table 46 and chairs 47 at spaced locations (see also FIG. 13.) Transparent glass paneling 49 extends along the upper mezzanine level 48. As seen in FIGS. 12 and 13, a floor to ceiling clear transparent glass window 50 brings light and openness from the outside environment into the interior of dining room 45 and mezzanine level 48.

Figure 14:
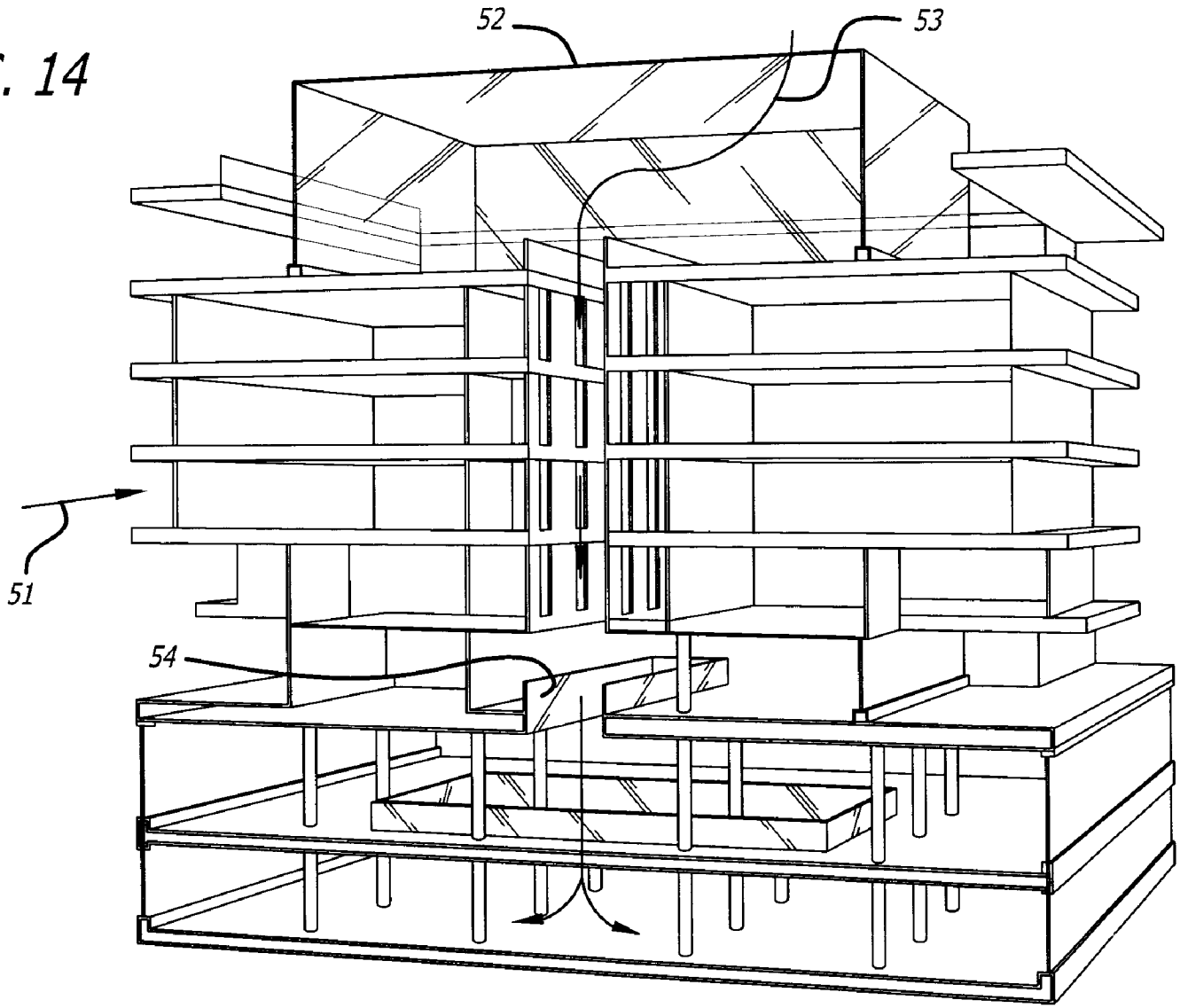
FIG. 14 is a perspective view of the grand atrium light well in accordance with the teachings of the invention.

Referring again to FIG. 1, the guests embarking on cruise ship 10 enter onto the fifth deck (for example) and, as particularly contemplated in the invention, an atrium light well 51 (see FIG. 14) may be provided extending from the 5th deck upwardly terminating at top in a glassed enclosure 52 forming a garden area which brings in light from the outside down between the floors as indicated by arrow 53. Transparent glass partitions, such as partitions 54, are used throughout so passengers can walk from one side of the middle area indicated by arrow 53 where light goes down between the floors of the decks.

Figure 15:
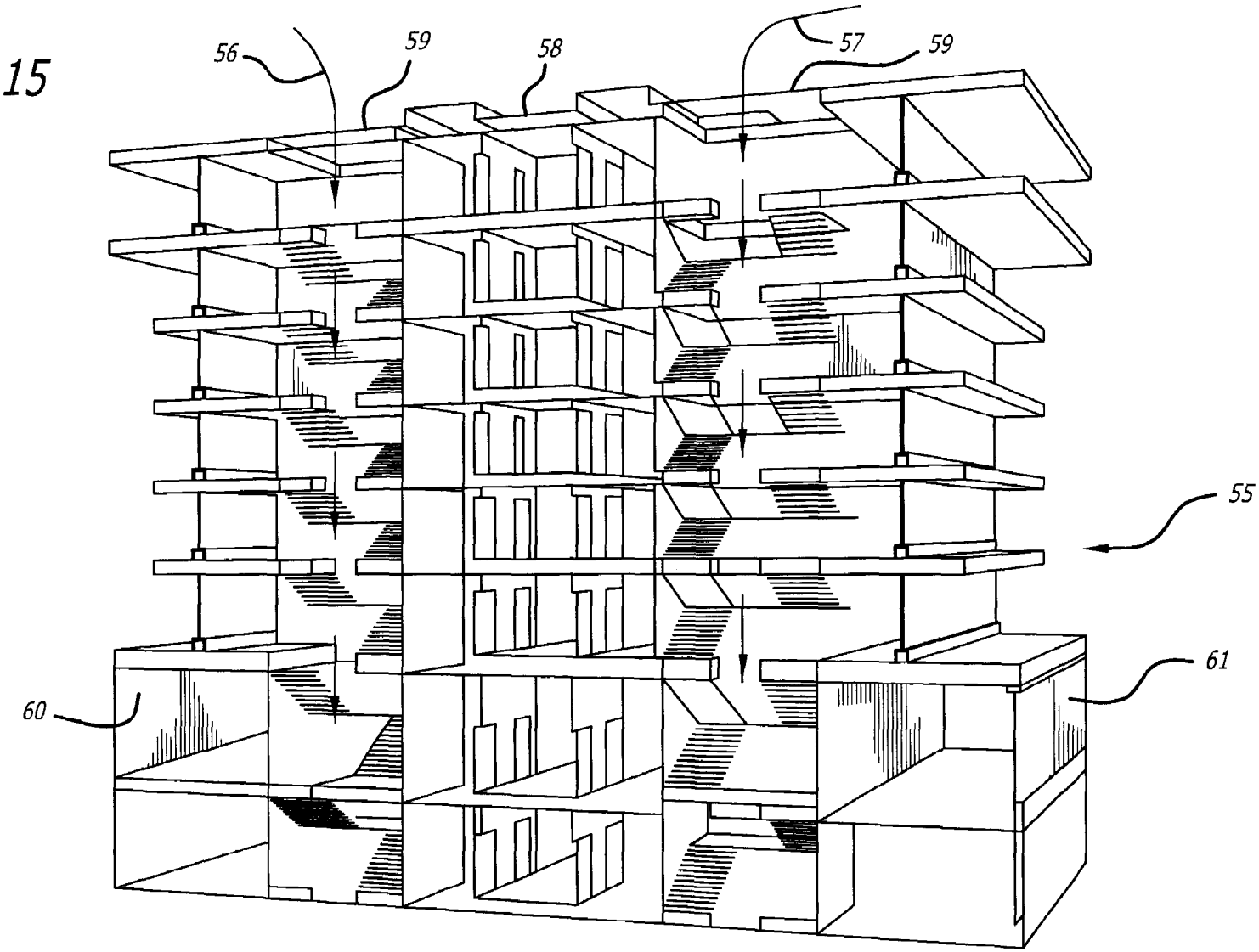
FIG. 15 is a perspective view of a vertical promenade in accordance with the teaching of the invention.

As seen in FIG. 1, one or more centrally located vertical promenades 55 (see FIG. 15) may be provided having a stairwell 56, 57 on each side of the central area 58. The clear glass ceiling 59 at top of each stairwell 56, 57 opens at the upper deck and brings sunlight in and down along the stairwell. The cruise passengers are bathed in sunlight as they go up and down the stairs in stairwells 56, 57. Corridors 60, 61 are on the outside of the stairwells 56, 57.

Figure 7:
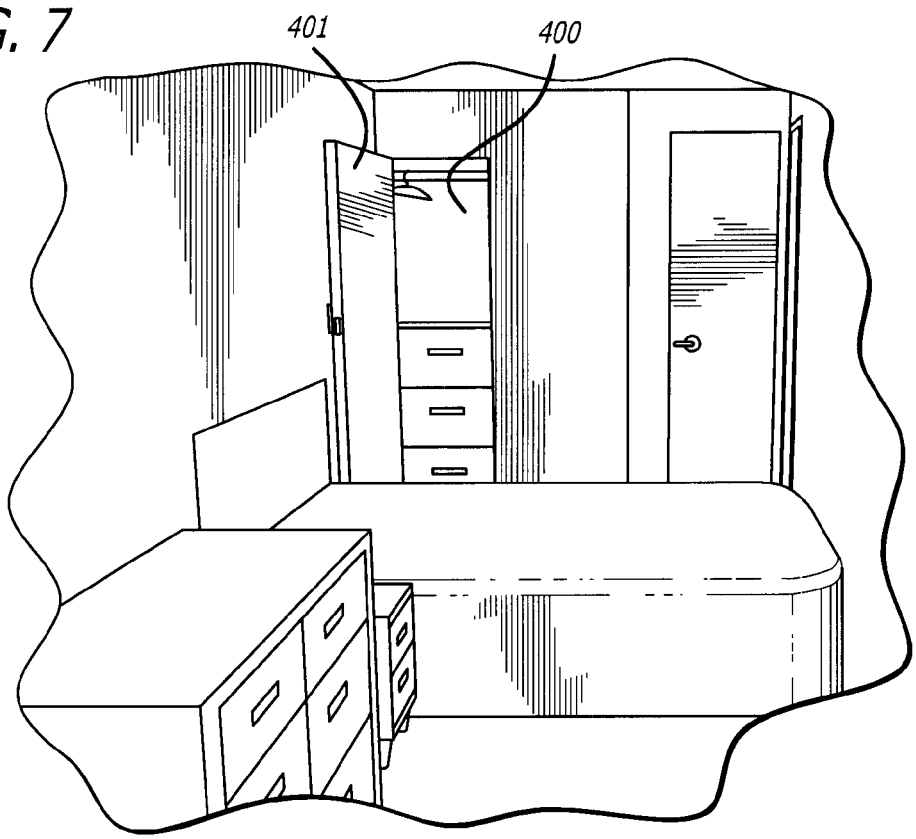
FIG. 7 is a perspective view of a portion of the interior of one of the staterooms.
Figure 8:
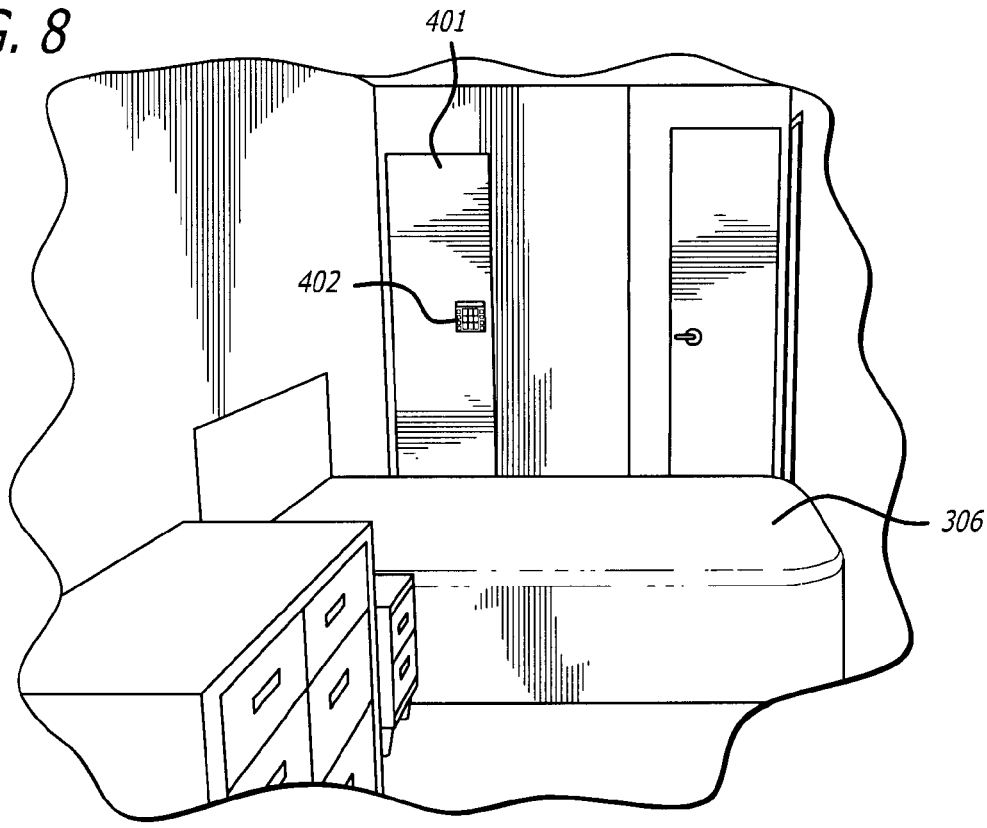
FIG. 8 is a view similar to FIG. 7 illustrating the lockable door leading into a safe or closet of one of the staterooms.

Looking again at FIG. 4, one area 400 in each suite 27, 28 may be a small safe or closet for the guest as seen in FIGS. 7 and 8. A door 401 leads into area 400 and, as seen in FIG. 8, door 401 has a combination lock 402 that can be set by the guest to any desired combination known only to the guest. Thus, the guest has a closet or safe where any valuables can be locked up.

It can be seen that there is disclosed a new type of cruise ship that is elegant, bathed in light throughout, contemporary and spacious. The interior environment of the cruise ship brings the light surrounding the ship into the interior of the ship. Clear structural glass is used throughout to provide an ambiance of light, order and calmness.

Corridor

The single central double height corridor includes both the upper and lower levels with structural clear glass partitions and a floor to ceiling window at the end spanning both levels. This gives an airy, open, spacious feeling to the double height central corridor bringing the outside light and ambiance into the interior of the cruise ship.

Staterooms

The improved staterooms feature double height loft living areas, floor to ceiling windows and unrestricted views. A shared entrance into a double stateroom provides privacy and the possibility of interconnecting rooms. By using a shared entrance for two standard staterooms, added space over conventional side by side staterooms allows for larger bathrooms with separate showers and full size bathtubs.

Main Dining Room

The main dining room includes a upper mezzanine level and double height windows extend upwardly from the main dining room to the mezzanine level. Alternative dining restaurants are located on the mezzanine level surrounded by glazing.

Grand Atrium Light Well and Vertical Promenades

The grand atrium 51 is of full height having a skylight at top and may have a winter garden on the interior. The grand atrium light well may extend from Deck 5 upwardly so that guests embarking on the cruise ship will experience a light filled and spacious grand atrium light well with clear views of the cruise ship. The guests will be provided with a view to the sky from the very heart of the ship.

Further, one or more vertical promenades may be provided midship, thus eliminating the need for forward and aft stairwells and having light flowing downwardly from the upper deck.

Closet Safe

Instead of a small safe in the room, the guest may use the entire closet as a safe, keying in his or her's own numeral or alphabetical code.

Crystal Effect

Figure 11:
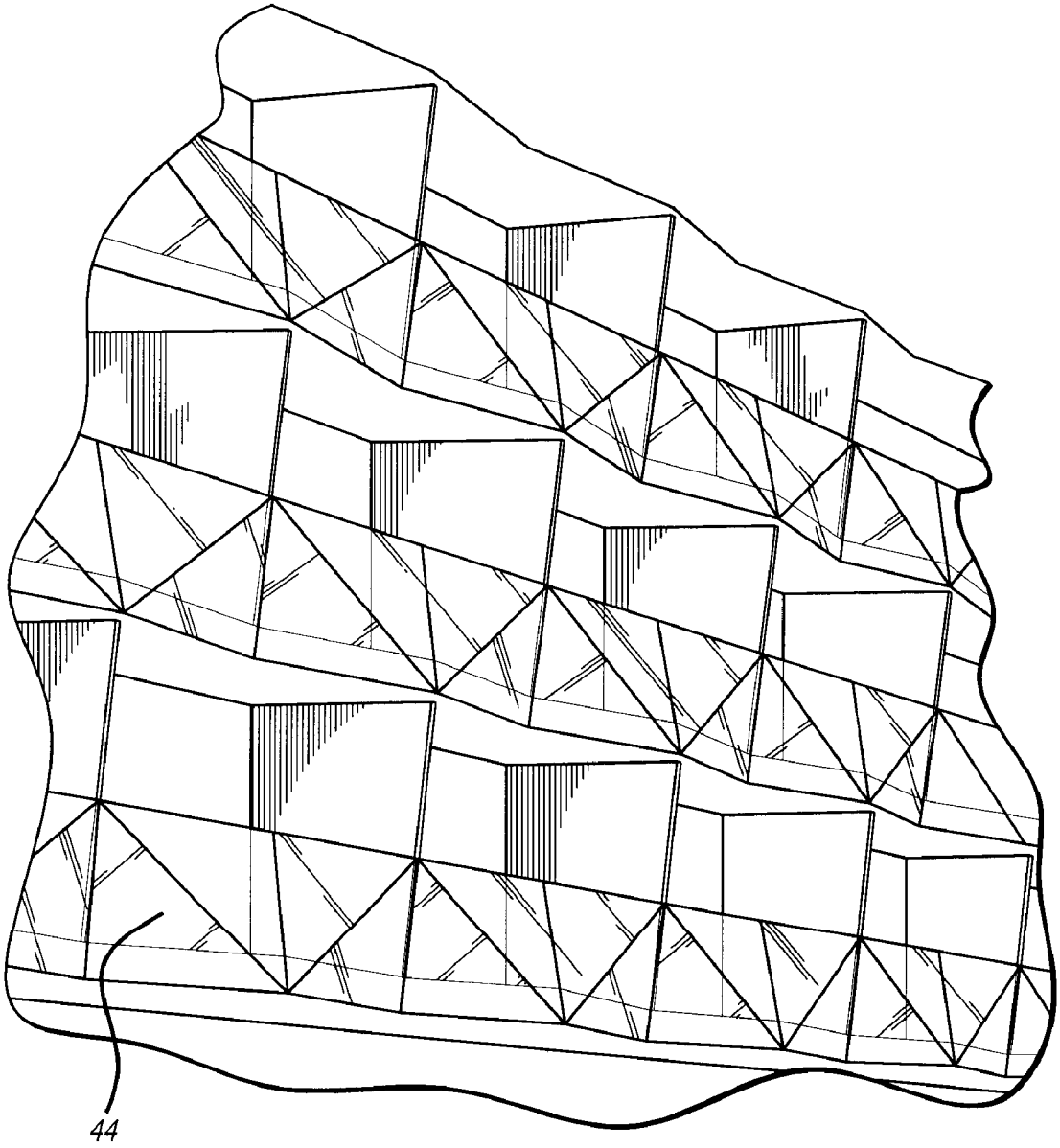
FIG. 11 is an elevational view of a portion of the outside of the cruise ship of FIG. 1.

The "crystal effect" in FIG. 11 lends a crystal-like appearance to the cruise ship. This appearance may be related to the name of the ship, e.g., "Crystal Harmony"®, carrying out the overall look and open environment effect.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

We claim:

1. In a cruise ship having a plurality of decks, certain of said decks having a plurality of staterooms therealong providing living quarters for passengers of the cruise ship, the improvement which comprises:

a bottom floor extending along one of said decks, said bottom floor having a first number of walls attached on opposite sides thereof defining first entrance ways to a plurality of spaced staterooms on opposite sides of said bottom floor, said first entrance ways having doors mounted therein to selectively allow access to said plurality of spaced staterooms;

an upper floor extending along another one of said decks, said upper floor having a second number of walls attached on opposite sides thereof defining second entrance ways to a second plurality of spaced staterooms on opposite sides of said upper floor, said second entrance ways having doors mounted therein to selectively allow access to said second plurality of spaced staterooms; and a single central double height corridor extending inboard of each said plurality of spaced staterooms, all of said staterooms opening on to said corridor, and said corridor terminating at one end in a transparent glass window extending from said one of said decks to said another of said decks.

2. The cruise ship of claim 1 wherein said one of said decks has a floor interconnecting said spaced staterooms thereon, and said another of said decks has a pair of spaced floor portions inboard of each of said plurality of spaced staterooms on another of said decks above said floor, and a glass panel extending along each of said floor portions inboard of said staterooms on said another of said decks.

3. The cruise ship of claim 2 including a plurality of passageways interconnecting said floor portions.

4. The cruise ship of claim 1 including at least a pair of said staterooms on each of said decks being side by side and having a shared entryway leading therein coming into said single central double height corridor.

5. The cruise ship of claim 4 wherein said one of said pair of staterooms has a door leading therein.

6. The cruise ship of claim 1 wherein at least one of said staterooms has an interior floor and has a first ceiling portion with a living room area having a second ceiling portion higher than said first ceiling portion.

7. The cruise ship of claim 6 wherein said living room area opens into a verandah.

8. The cruise ship of claim 1 wherein at least one of said staterooms has a normally unlocked area on its interior with a combination lock having coded changeable inputs accessible by the user of the stateroom for allowing a coded combination to be input by the user to provide both locking and unlocking into said area.

9. The cruise ship of claim 1 wherein said normally unlocked area is a closet or safe.

10. The cruise ship of claim 1 wherein said cruise ship has a main dining room with a floor and ceiling on another of said decks remote from said first mentioned decks, and a mezzanine area above said main dining room above said another of said decks, said main dining room opening upwardly past said mezzanine area to said ceiling and a floor to ceiling transparent glass window closing off the main dining room extending from the floor to ceiling thereof past said mezzanine area.

11. The cruise ship of claim 10, wherein said mezzanine area has an outer edge above said main dining room floor and including a glass partition extending along the outer edge of said mezzanine area.

12. The cruise ship of claim 2 wherein at least one of said decks has an outboard area, said outboard area being closed off by a plurality of transparent crystal-like glass sections presenting a crystal effect.

13. The cruise ship of claim 1 wherein said cruise ship has a plurality of lower decks and an upper deck and including a grand atrium light well disposed at about the midpoint of said cruise ship extending from one of said lower decks to said upper deck for providing viewing areas to the cruise ship passengers as they traverse the vertical promenade from the lower deck to said upper deck.

14. The cruise ship of claim 13 wherein at least 5 decks are provided and said grand atrium light well extends from the 5th deck to said upper deck.

15. The cruise ship of claim 13 wherein said grand atrium light well terminates in a skylight at said upper deck.

16. The cruise ship of claim 15 wherein a winter garden area surrounds said grand atrium light well at said upper deck below said skylight.

17. The cruise ship of claim 13 wherein at least one promenade extends from said lower deck to said upper deck.

18. The cruise ship of claim 13 wherein a pair of stairwells extend along said vertical promenade on opposite sides of said vertical promenade from said lower deck to said upper deck.

19. In a cruise ship having a plurality of decks, certain of said decks having a plurality of staterooms therealong, the improvement which comprises:

a plurality of spaced staterooms extending along one of said decks on opposite sides thereof;

a second plurality of spaced staterooms extending along another of said decks on the opposite side thereof directly above the said one of said decks; and a single central double height corridor extending inboard of each said plurality of spaced staterooms, and said corridor terminating at one end in a transparent glass window extending from said one of said decks to said another of said decks, said cruise ship having a main dining room with a floor and ceiling on another of said decks remote from said first mentioned decks, and a mezzanine area above said main dining room above said another of said decks, said main dining room opening upwardly past said mezzanine area to said ceiling and a floor to ceiling transparent glass window closing off the main dining room extending from the floor to ceiling thereof past said mezzanine area.

20. The cruise ship of claim 19, wherein said mezzanine area has an outer edge above said main dining room floor and including a glass partition extending along the outer edge of said mezzanine area.

21. The cruise ship of claim 1, wherein said central double height corridor is a hallway.

22. The cruise ship of claim 1, wherein said transparent glass window is on the exterior of said ship.

23. The cruise ship of claim 1, wherein said central double height corridor is exactly two decks high.

* * * * *